US006772709B2

(12) United States Patent
Shibata

(10) Patent No.: US 6,772,709 B2
(45) Date of Patent: Aug. 10, 2004

(54) VARNISH COATING APPARATUS

(75) Inventor: Satoshi Shibata, Ibaraki (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/319,033

(22) Filed: Dec. 13, 2002

(65) Prior Publication Data

US 2003/0111010 A1 Jun. 19, 2003

(30) Foreign Application Priority Data

Dec. 14, 2001 (JP) ..... 2001-381460

(51) Int. Cl.[7] ..... B05C 1/02

(52) U.S. Cl. ..... 118/46; 118/212; 118/227; 118/236; 118/244; 118/249; 118/255; 118/262; 101/229; 101/231

(58) Field of Search ..... 118/46, 212, 227, 118/236, 244, 249, 255, 262; 427/428, 208, 208.8, 209, 211; 101/220, 229, 231

(56) References Cited

U.S. PATENT DOCUMENTS 4,188,883 A * 2/1980 Schone et al. ..... 101/183
4,664,949 A * 5/1987 Greiner et al. ..... 427/210
5,309,839 A 5/1994 Hartung et al.
5,651,316 A * 7/1997 DeMoore et al. ..... 101/450.1
6,143,074 A * 11/2000 Komori ..... 118/209
6,283,025 B1 * 9/2001 Simeth ..... 101/183

FOREIGN PATENT DOCUMENTS

| | | | |
|---|---|---|---|
| DE | 0564856 | A | 4/1997 |
| EP | 0564856 | A1 | 11/1932 |
| JP | 2579258 | U | 6/1998 |
| JP | 10-296953 | A | 11/1998 |
| JP | 11-105249 | A | 4/1999 |
| JP | 2000-103035 | A | 4/2000 |

* cited by examiner

*Primary Examiner*—Laura Edwards
(74) *Attorney, Agent, or Firm*—Blakely Sokoloff Taylor & Zafman

(57) ABSTRACT

In a varnish coating apparatus, a first varnish film forming cylinder has a first supply surface to which varnish is supplied. A second varnish film forming cylinder has a second supply surface to which varnish is supplied. A first blanket cylinder has a first transfer surface and first opposing surface. A second blanket cylinder has a second transfer surface and second opposing surface. When a sheet passes through a contact point between the first and second blanket cylinders, the first transfer surface of the first blanket cylinder opposes the second opposing surface of the second blanket cylinder to perform varnish coating on a first surface of the sheet, and the second transfer surface of the second blanket cylinder opposes the first opposing surface of the first blanket cylinder so as to perform varnish coating on a second surface of the sheet.

16 Claims, 6 Drawing Sheets

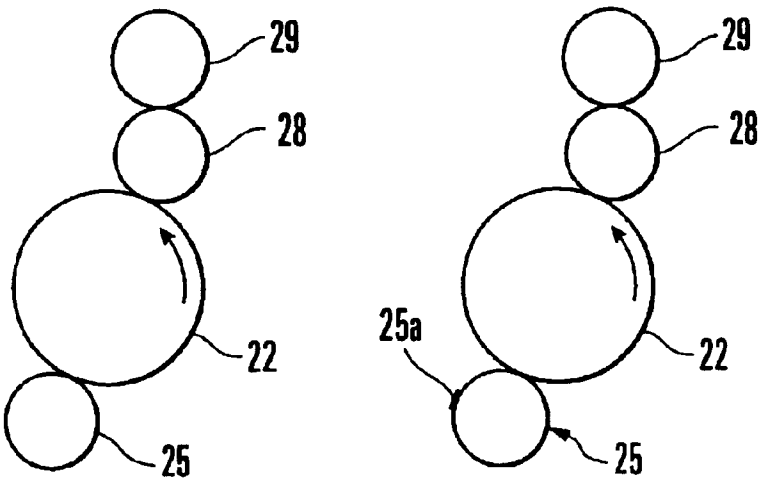
FIG.6A
FIG.6B
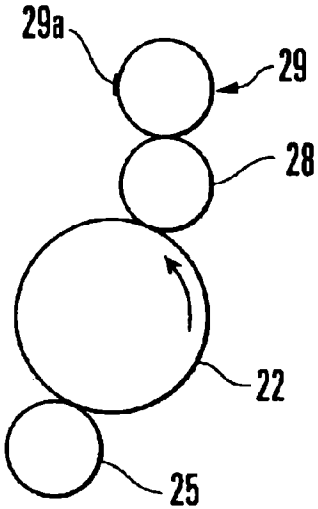
FIG.6C
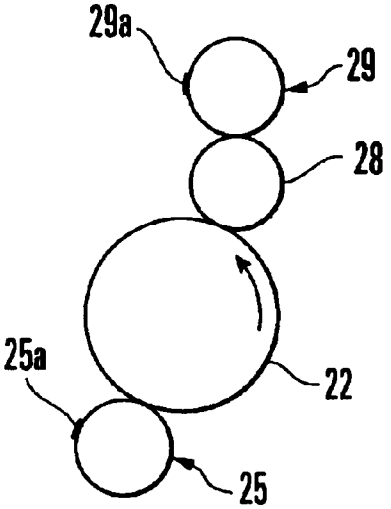
FIG.6D

VARNISH COATING APPARATUS

BACKGROUND OF INVENTION

The present invention relates to a varnish coating apparatus for coating a sheet-like matter with varnish to prevent stains on a printed sheet-like matter or obtain a better appearance of it and, more particularly, to a varnish coating apparatus for coating both surfaces of a sheet-like matter with varnish in a single path.

Japanese Patent Laid-Open No. 10-296953 (reference 1) discloses a coating apparatus which coats both surfaces (obverse and reverse surfaces) of a sheet-like matter with varnish in a single path without inverting the sheet-like matter. A coating unit 80 disclosed in reference 1 is arranged downstream in the paper convey direction of a printing section (not shown). The coating unit 80 has a blanket impression cylinder 82 in contact with a transfer cylinder 81 of the printing section, and first and second varnish coating units 83 and 84, as shown in FIG. 8.

The first varnish coating unit 83 is arranged upstream in the paper convey direction from the contact point between the blanket impression cylinder 82 and the transfer cylinder 81. The first varnish coating unit 83 is constituted by a varnish pan 86*a* which stores varnish, a fountain roller 87*a* dipped in varnish in the varnish pan 86*a*, a metering roller 88*a* in contact with the fountain roller 87*a*, a form roller 89*a* in contact with the metering roller 88*a*, and a coater cylinder 85*a* in contact with the form roller 89*a* and opposing a paper sheet held by the transfer cylinder 81.

In this arrangement, varnish in the varnish pan 86*a* is transferred to the coater cylinder 85*a* through the fountain roller 87*a*, metering roller 88*a*, and form roller 89*a* and then to the peripheral surface of the blanket impression cylinder 82 through the coater cylinder 85*a*. The first varnish coating unit 83 which is arranged upstream in the paper convey direction from the contact point between the blanket impression cylinder 82 and the transfer cylinder 81 transfers varnish to the peripheral surface of the blanket cylinder 82 before it receives the paper sheet from the transfer cylinder 81. Accordingly, when the paper sheet transferred from the transfer cylinder 81 to the blanket impression cylinder 82 passes through the contact point between the blanket impression cylinder 82 and a coater cylinder 85*b* of the second varnish coating unit 84, varnish transferred to the peripheral surface of the blanket impression cylinder 82 is transferred to the reverse surface of the paper sheet by the printing pressure of the coater cylinder 85*b* so that the reverse surface is coated with varnish.

The second varnish coating unit 84 is arranged downstream in the paper convey direction from the contact point between the blanket impression cylinder 82 and the transfer cylinder 81. Like the above-described first varnish coating unit 83, the second varnish coating unit 84 is constituted by a varnish pan 86*b*, a fountain roller 87*b*, a metering roller 88*b*, a form roller 89*b*, and the coater cylinder 85*b*. In this arrangement, varnish in the varnish pan 86*b* is transferred to the coater cylinder 85*b* through the fountain roller 87*b*, metering roller 88*b*, and form roller 89*b*. When the paper sheet passes through the contact point between the blanket impression cylinder 82 and the coater cylinder 85*b*, varnish on the coater cylinder 85*b* is transferred to the obverse surface of the paper sheet so that the obverse surface is coated with varnish.

After coating, the paper sheet is gripped from the transfer cylinder 81 by the blanket impression cylinder 82. The paper sheet whose obverse and reverse surfaces are coated with varnish is gripped by delivery grippers (not shown) of a delivery chain 91. The gripped paper sheet is conveyed by the delivery chain 91. The applied varnish is dried by drying units 92, 93, and 94 during conveyance. Then, the paper sheet is dropped onto a delivery pile (not shown) and stacked.

In the conventional coating apparatus, when pattern coating or partial coating is necessary for the obverse surface of a paper sheet, a printing plate having a projecting portion is attached in correspondence with a patterned coating portion in place of the blanket attached on the peripheral surface of the coater cylinder 85*b* of the second varnish coating unit 84.

However, as shown in FIG. 9, if double-side coating is to be performed in which a pattern coating region 9B on the reverse surface of a paper sheet 9 does not overlap a pattern coating region 9A of the obverse surface of the paper sheet 9, the pattern coating region 9B on the reverse surface is pressed by the recessed portion of the printing plate, and therefore, no sufficient printing pressure is applied to the coating region 9B on the reverse surface. In addition, when full coating is to be performed on the reverse surface, no sufficient printing pressure is applied to the reverse surface region that does not correspond to the pattern coating region on the obverse surface. For this reason, the conventional coating apparatus cannot perform pattern coating on the reverse surface of a paper sheet when the obverse surface of the paper sheet is to be pattern-coated.

To solve this problem, a coating apparatus disclosed in Japanese Patent Laid-Open No. 2000-103035 (reference 2) is proposed. The coating apparatus disclosed in reference 2 has a first coating unit which coats the obverse surface of a paper sheet on the peripheral surface of an odd-numbered cylinder (to be referred to as an odd-number cylinder hereinafter) located from the upstream side to the downstream side in the paper convey direction, a second coating unit which coats the reverse surface of the paper sheet on the peripheral surface of an even-numbered cylinder (to be referred to as an even-number cylinder hereinafter), and a drying unit arranged downstream of each coating unit.

In this arrangement, the obverse surface of a paper sheet is coated by the first coating unit on the peripheral surface of an odd-number cylinder. After that, the varnish applied to the obverse surface is dried by the drying unit. Subsequently, the reverse surface of the paper sheet is coated by the second coating unit on the peripheral surface of an even-number cylinder. After that, the varnish applied to the reverse surface is dried by the drying unit. In this way, the obverse and reverse surfaces of a paper sheet are coated selectively on the odd-and even-number cylinders, thereby making pattern coating on both the obverse and reverse surfaces of a paper sheet.

In the above-described coating apparatus, however, since the obverse and reverse surfaces of a paper sheet are selectively coated on the odd- and even-number cylinders, a cylinder dedicated to obverse surface coating and that dedicated to reverse surface coating are necessary. This increases the manufacturing cost and also increase the total length of the machine. In addition, in winding a paper sheet around the cylinder dedicated to reverse surface coating after obverse surface coating, a drying unit is required to prevent varnish on the obverse surface of a paper sheet from sticking to the cylinder dedicated to reverse surface coating. In this case, the varnish must be dried in a short time. To do this, a bulky drying unit is necessary, resulting in an increase in manufacturing cost.

SUMMARY OF THE INVENTION

It is an object of the present invention to provide a coating apparatus capable of reliably executing double-side coating including pattern coating on the reverse surface of a sheet-like matter.

It is another object of the present invention to provide a varnish coating apparatus which reduces the size and manufacturing cost.

In order to achieve the above objects, according to the present invention, there is provided a varnish coating apparatus comprising a first varnish film forming cylinder having a first supply surface to which varnish is supplied, a second varnish film forming cylinder having a second supply surface to which varnish is supplied, a first blanket cylinder having a first transfer surface in contact with the first supply surface of the first varnish film forming cylinder and a first opposing surface corresponding to the second supply surface of the second varnish film forming cylinder, and a second blanket cylinder arranged in contact with the first blanket cylinder and having a second transfer surface in contact with the second supply surface of the second varnish film forming cylinder and a second opposing surface corresponding to the first supply surface of the first varnish film forming cylinder, wherein when a sheet passes through a contact point between the first and second blanket cylinders, the first transfer surface of the first blanket cylinder opposes the second opposing surface of the second blanket cylinder to perform varnish coating on a first surface of the sheet, and the second transfer surface of the second blanket cylinder opposes the first opposing surface of the first blanket cylinder to perform varnish coating on a second surface of the sheet.

BRIEF DESCRIPTION OF THE DRAWINGS

FIGS. 6A to 6D are views for explaining operation of each coating type;

DESCRIPTION OF THE PREFERRED EMBODIMENTS

The present invention will be described below in detail with reference to the accompanying drawings.

Figure 1:
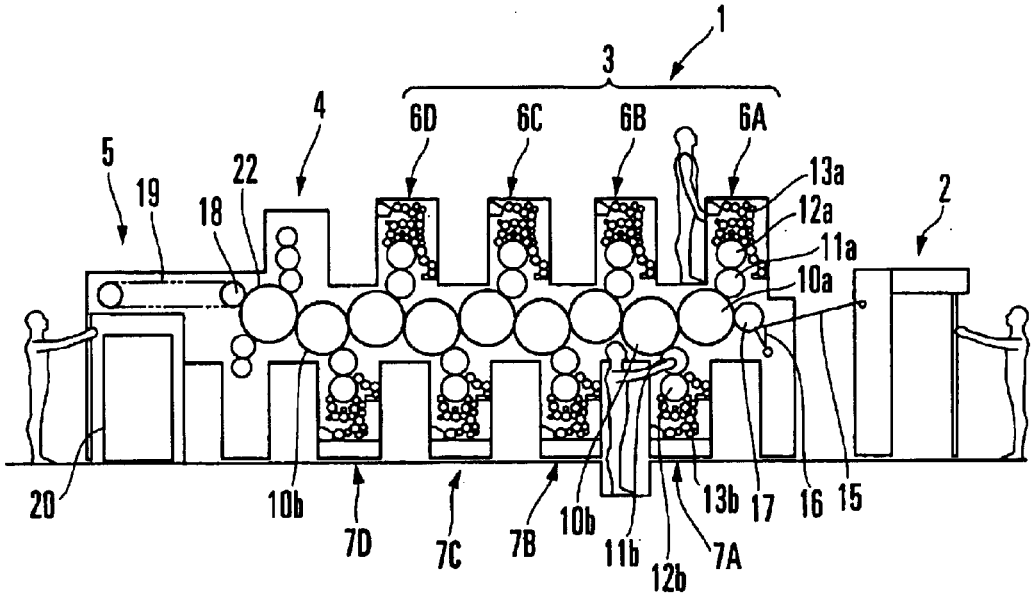
FIG. 1 is a side view of a sheet-fed rotary press to which a coating apparatus according to the first embodiment of the present invention is applied.

FIGS. 1 to 6D show a coating apparatus according to the first embodiment of the present invention. As shown in FIG. 1, a sheet-fed rotary press 1 has a sheet feeder section 2 which feeds a paper sheet as a sheet-like matter, a printing section 3 which prints the paper sheet fed from the sheet feeder section 2, a coating section 4 which coats the obverse and reverse surfaces of the paper sheet printed by the printing section 3 with varnish, and a delivery section 5 which delivers the paper sheet coated by the coating section 4. The printing section 3 is constituted by first to fourth obverse surface printing units 6A to 6D and first to fourth reverse surface printing units 7A to 7D arranged on the lower side of the obverse surface printing units 6A to 6D. The obverse surface printing units 6A to 6D and reverse surface printing units 7A to 7D are alternately arranged in the paper feed direction.

Each of the obverse surface printing units 6A to 6D has a double-diameter impression cylinder 10*a* having, on its peripheral surface, grippers which grip a paper sheet, a blanket cylinder 11*a* in contact with the upper portion of the impression cylinder 10*a*, a plate cylinder 12*a* in contact with the upper portion of the blanket cylinder 11*a*, and an ink section 13*a* which supplies ink to the plate cylinder 12*a*. Each of the reverse surface printing units 7A to 7D has a double-diameter impression cylinder 10*b* having, on its peripheral surface, grippers which grip a paper sheet, a blanket cylinder 11*b* in contact with the lower portion of the impression cylinder 10*b*, a plate cylinder 12*b* in contact with the lower portion of the blanket cylinder 11*b*, and an ink section 13*b* which supplies ink to the plate cylinder 12*b*.

In this arrangement, the leading edge of a paper sheet supplied from the sheet feeder section 2 to a feeder board 15 is gripped by a swing unit 16 and then by the grippers of the impression cylinder 10*a* of the first obverse surface printing unit 6A. The first color is printed on the obverse surface of the paper sheet gripped by the grippers of the impression cylinder 10*a* when the paper sheet passes through the contact point between the impression cylinder 10*a* and the blanket cylinder 11*a*. The paper sheet having the first color printed on the obverse surface is then gripped by the impression cylinder 10*b* of the first reverse surface printing unit 7A. The first color is printed on the reverse surface of the paper sheet gripped by the impression cylinder 10*b* when the paper sheet passes through the contact point between the impression cylinder 10*b* and the blanket cylinder 11*b*. After that, the second to fourth colors are sequentially printed on the obverse and reverse surfaces by the second to fourth obverse surface printing units 6B to 6D and the second to fourth reverse surface printing units 7B to 7D in the same way as described above.

The obverse and reverse surfaces of the paper sheet with the four colors printed on its obverse and reverse surfaces are coated with varnish by the coating unit 4. The coated paper sheet is gripped by the delivery grippers (not shown) of a delivery chain 19 of the delivery unit 5. The paper sheet is conveyed by the delivery chain 19, dropped onto a delivery pile 20, and stacked.

Figure 2:
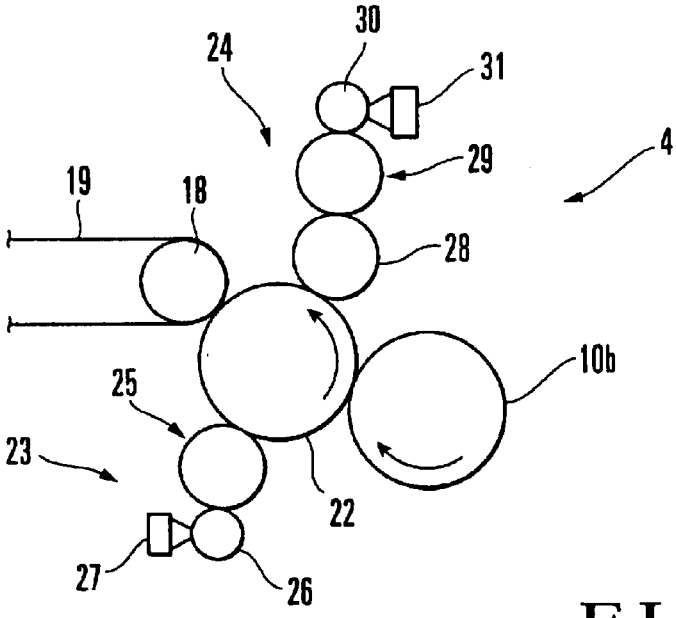
FIG. 2 is an enlarged side view of a printing section shown in FIG. 1.

The coating unit 4 will be described next. As shown in FIG. 2, the coating unit 4 has a blanket impression cylinder (first blanket cylinder) 22 in contact with the impression cylinder 10*b* of the fourth reverse surface printing unit 7D, a first varnish coating unit 23 which coats the reverse surface of the printed paper sheet, and a second varnish coating unit 24 which coats the obverse surface of the printed paper sheet.

The first varnish coating unit 23 is formed from a varnish film forming cylinder 25 in contact with the blanket impression cylinder 22 upstream in the paper convey direction from the contact point between the blanket impression cylinder 22 and the impression cylinder 10*b*, an anilox roller 26 in contact with the varnish film forming cylinder 25, and a chamber coater 27 which supplies varnish to the anilox roller 26. Varnish supplied from the chamber coater 27 to the anilox roller 26 is transferred onto the peripheral surface of the blanket impression cylinder 22 through the varnish film forming cylinder 25.

The second varnish coating unit 24 is formed from a blanket cylinder (second blanket cylinder) 28 in contact with the blanket impression cylinder 22 downstream in the paper convey direction from the contact point between the blanket impression cylinder 22 and the impression cylinder 10*b*, a varnish film forming cylinder 29 in contact with the blanket cylinder 28, an anilox roller 30 in contact with the varnish film forming cylinder 29, and a chamber coater 31 which supplies varnish to the anilox roller 30. Varnish supplied from the chamber coater 31 to the anilox roller 30 is transferred to the blanket cylinder 28 through the varnish film forming cylinder 29. The printed paper sheet passes through the contact point between the blanket cylinder 28 and the blanket impression cylinder 22. At this time, the obverse surface of the paper sheet is coated with varnish transferred to the blanket cylinder 28. In addition, when the printed paper sheet passes through the contact point between the blanket cylinder 28 and the blanket impression cylinder 22, the reverse surface of the paper sheet is coated, by the printing pressure of the blanket cylinder 28, with varnish transferred from the varnish film forming cylinder 25 of the first varnish coating unit 23 to the peripheral surface of the blanket impression cylinder 22.

Figure 3:
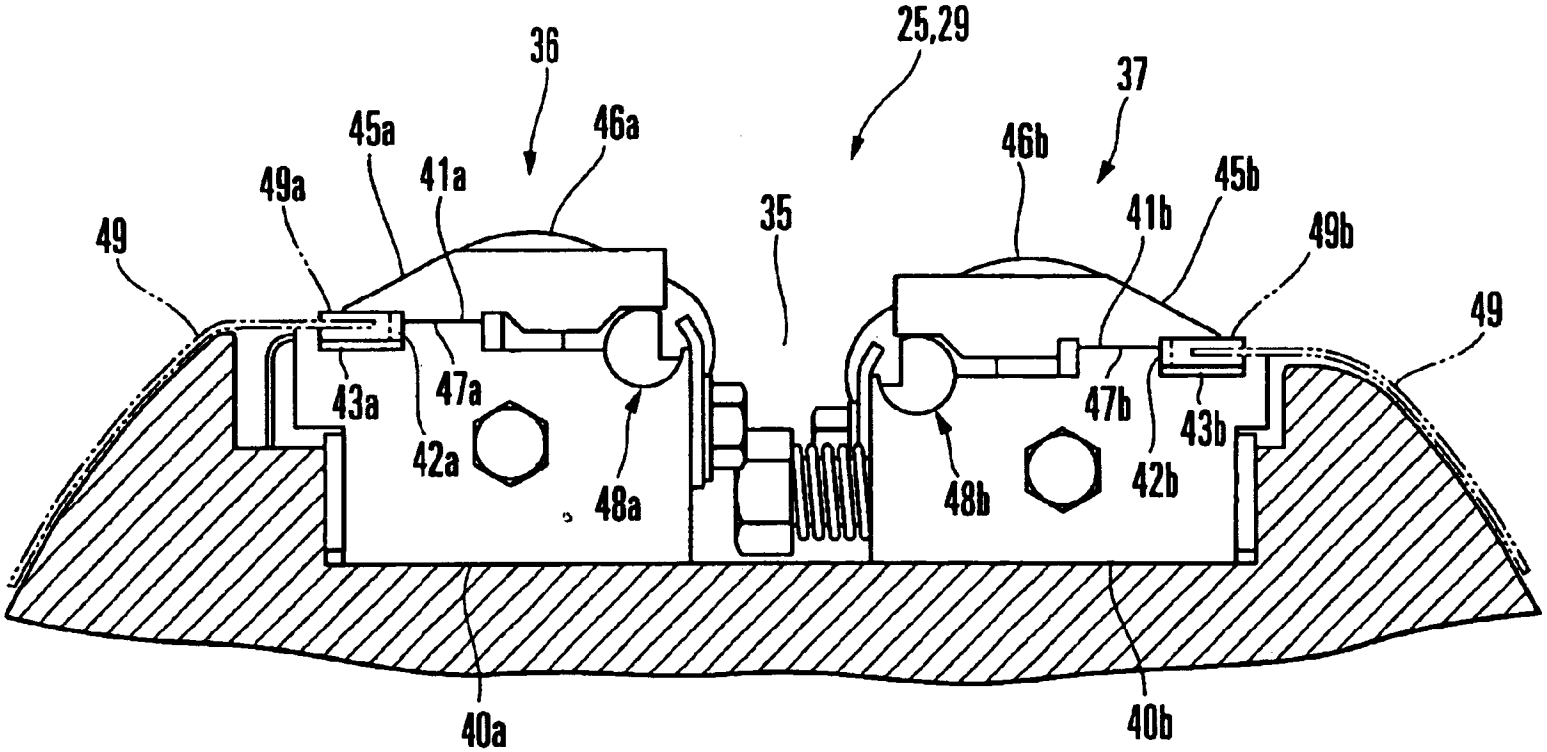
FIG. 3 is a sectional view of the main portion of a varnish film forming cylinder shown in FIG. 2.

The structure of the varnish film forming cylinder 25 or 29 will be described next. As shown in FIG. 3, each of the first and second varnish film forming cylinders 25 and 29 has, on its peripheral surface, a notch 35 that runs the full length of the cylinder 25 or 29. In the notch 35, a leading edge plate clamp 36 which grips the leading edge of a plate and a trailing edge plate clamp 37 which grips the trailing edge of the plate are arranged in parallel along the axial direction of the cylinder. The leading edge plate clamp 36 and trailing edge plate clamp 37 have gripping surfaces 41*a* and 41*b*, respectively. The plate clamps 36 and 37 also respectively have bottom clamping rails 40*a* and 40*b* extending in the axial direction of the cylinder. Base insertion grooves 42*a* and 42*b* having bottom surfaces parallel to the gripping surfaces 41*a* and 41*b* are formed parts of the gripping surfaces 41*a* and 41*b*. Spacers 43*a* and 43*b* are fixed to the bottom surfaces of the base insertion grooves 42*a* and 42*b*.

Gripper boards 45*a* and 45*b* have gripping surfaces 47*a* and 47*b* which grip the plate cooperatively with the gripping surfaces 41*a* and 41*b* of the bottom clamping rails 40*a* and 40*b*. The gripper boards 45*a* and 45*b* are supported by bolts 46*a* and 46*b* screwed in the upper portions of the bottom clamping rails 40*a* and 40*b* so as to freely swing. The gripper boards 45*a* and 45*b* have distal end portions that cover the base insertion grooves 42*a* and 42*b*. Round rod-shaped cams 48*a* and 48*b* are arranged in the axial direction of the cylinder to come into contact with the rear portions of the gripper boards 45*a* and 45*b*. When cams 48*a* and 48*b* pivot, the gripper boards 45*a* and 45*b* swing about the bolts 46*a* and 46*b*, respectively.

In this arrangement, to attach a blanket 49 having bases 49*a* and 49*b* at two ends to the varnish film forming cylinder 25 or 29, the base 49*a* is inserted into the base insertion groove 42*a* of the bottom clamping rail 40*a*. After that, the cam 48*a* is pivoted to cover the base insertion groove 42*a* with the distal end portion of the cam gripper board 45*a*. Next, the blanket 49 is wound around the peripheral surface of the varnish film forming cylinder 25 or 29. After the base 49*b* is inserted into the base insertion groove 42*b* of the bottom clamping rail 40*b*, the cam 48*b* is pivoted to cover the base insertion groove 42*b* with the distal end portion of the cam gripper board 45*b*. When the bottom clamping rails 40*a* and 40*b* are slid to the center of the notch 35 such that they come close to each other, the blanket 49 is stretched and comes into tight contact with the peripheral surface of the cylinder.

A plate member for pattern coating is attached to the varnish film forming cylinder 25 or 29. For example, when a lithographic printing plate (PS plate) serving as a plate member for pattern coating, which is prepared by bonding a resin relief printing plate having a pattern coating image formed on the surface, is to be attached to the varnish film forming cylinder 25 or 29, one end of the lithographic printing plate is inserted between the gripping surface 47*a* of the gripper board 45*a* and the gripping surface 41*a* of the bottom clamping rail 40*a*. Next, the cam 48*a* is pivoted to make the gripping surface 47*a* of the gripper board 45*a* and the gripping surface 41*a* of the bottom clamping rail 40*a* grip one end of the lithographic printing plate. Then, the lithographic printing plate is wound around the peripheral surface of the varnish film forming cylinder 25 or 29. The other end of the lithographic printing plate is inserted between the gripping surface 47*b* of the gripper board 45*b* and the gripping surface 41*b* of the bottom clamping rail 40*b*. Next, the cam 48*b* is pivoted to make the gripping surface 47*b* of the gripper board 45*b* and the gripping surface 41*b* of the bottom clamping rail 40*b* grip the other end of the lithographic printing plate. When the bottom clamping rails 40*a* and 40*b* are slid to the center of the notch 35 such that they come close to each other, the lithographic printing plate is stretched and comes into tight contact with the peripheral surface of the cylinder.

Figure 4B:
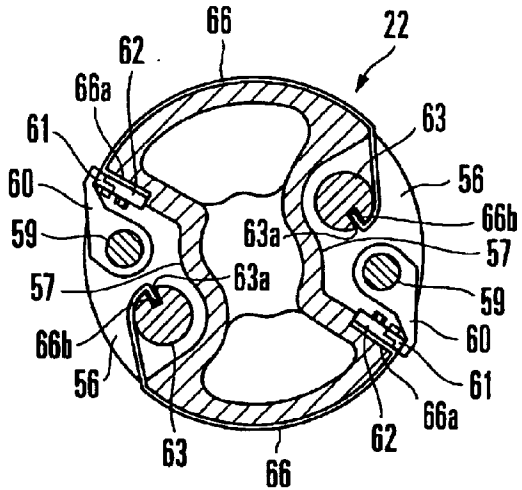
FIG. 4B is a sectional view taken along a line I—I in FIG. 4A.
Figure 4A:
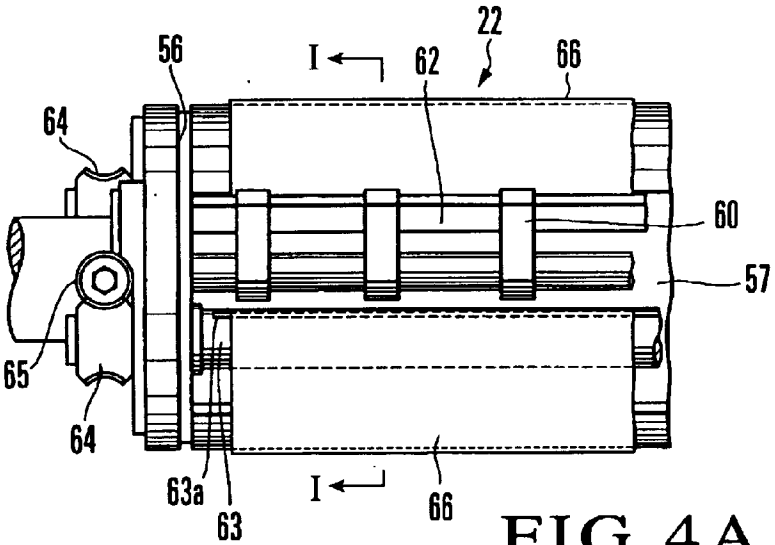
FIG. 4A is a front view of the main portion of a first blanket cylinder shown in FIG. 2.

The structure of the blanket impression cylinder 22 will be described next. As shown in FIG. 4A, a pair of notches 57 are formed in the outer periphery of the blanket impression cylinder 22 across its full length while being phase-shifted by 180° in the circumferential direction. The two ends of each notch 57 are closed by a pair of bearers 56 having a disk shape. In each notch 57, a gripper shaft 59 is axially arranged in parallel to the cylinder axial direction, as shown in FIG. 4B. A plurality of grippers 60 for gripping a paper sheet are fixed on the gripper shaft 59 at a predetermined interval. A shaft end portion of the gripper shaft 59, which projects from one of the bearers 56, has a cam mechanism (not shown) that opens/closes the grippers 60. A gripper pad 61 which grips a paper sheet together with the grippers 60 is fixed on the wall surface of each notch 57 through a gripper pad bar 62.

In each notch 57, a winding bar 63 whose two ends are axially supported by the pair of bearers 56 is arranged in parallel to the cylinder axial direction. A kerf 63*a* is formed in the peripheral surface of the winding bar 63 across its full length. A worm wheel 64 is axially attached to an end portion of the winding bar 63, which projects from one of the bearers 56. A worm 65 meshed with the worm wheel 64 is supported by the bearer 56.

In this arrangement, a base 66*a* of a blanket 66 is fixed to the step portion on the wall surface of the notch 57 by the gripper pad bar 62. After the blanket 66 is wound around about half of the peripheral surface of the blanket impression cylinder 22, a base 66*b* of the blanket 66 is inserted into the kerf 63*a* of the winding bar 63. Next, when the worm 65 is pivoted, the winding bar 63 pivots through the worm wheel 64. The blanket 66 is clamped and wound in tight contact with the cylinder peripheral surface.

Figure 5:
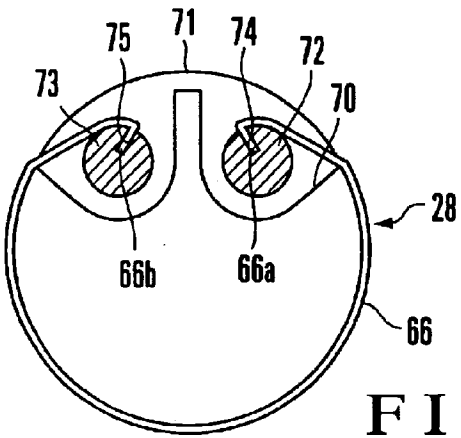
FIG. 5 is a sectional view of a second blanket cylinder shown in FIG. 2.

The structure of the blanket cylinder 28 will be described next. As shown in FIG. 5, a notch 70 is formed in the peripheral surface of the blanket cylinder 28 across its full length. Two ends of the notch 70 are closed by a pair of bearers 71 having a disk shape. In the notch 70, a pair of winding bars 72 and 73 each having two ends axially supported by the pair of bearers 71 are arranged in parallel to the cylinder axial direction. Kerfs 74 and 75 are formed in the peripheral surfaces of the winding bars 72 and 73 across their full length. A pivoting member (not shown) for pivoting the winding bars 72 and 73 is attached to end portions of the winding bars 72 and 73, which project from one of the bearers 71.

In this arrangement, the base 66*a* of the blanket 66 is inserted into the kerf 74 of the winding bar 72. After the blanket 66 is wound around about half of the peripheral surface of the blanket cylinder 28, the base 66*b* of the blanket 66 is inserted into the kerf 75 of the other winding bar 73. Next, when the pivoting member (not shown) is pivoted, the winding bars 72 and 73 pivot. The blanket 66 is clamped and wound in tight contact with the cylinder peripheral surface.

The coating operation of the coating apparatus having the above arrangement will be described next with reference to FIGS. 6A to 6D. First, a case wherein full coating is performed on both the obverse and reverse surfaces of a paper sheet will be described, as shown in FIG. 6A.

In this case, as described with reference to FIG. 3, the blankets 49 are attached to the peripheral surfaces of the varnish film forming cylinder 25 of the first varnish coating unit 23 and the varnish film forming cylinder 29 of the second varnish coating unit 24, respectively. In such an arrangement, a paper sheet whose obverse and reverse surfaces are printed by the printing section 3 is gripped from the impression cylinder 10*b* by the grippers 60 of the blanket impression cylinder 22. As shown in FIG. 6A, when the paper sheet gripped by the grippers 60 passes through the contact point to the blanket cylinder 28, the entire obverse surface of the paper sheet is coated with varnish transferred from the blanket cylinder 28. Simultaneously, varnish is transferred from the peripheral surface of the blanket impression cylinder 22 by the printing pressure of the blanket cylinder 28 so that the entire reverse surface of the paper sheet is coated with varnish.

A case wherein full coating is performed on the obverse surface of a paper sheet, and pattern coating is performed on the reverse surface of the paper sheet will be described next.

In this case, a lithographic printing plate bonded to a resin relief printing plate 25*a* having a pattern coating image formed on its surface is attached to the peripheral surface of the varnish film forming cylinder 25 of the first varnish coating unit 23, as shown in FIG. 6B. A portion on the peripheral surface of the varnish film forming cylinder 25, which corresponds to the resin relief printing plate 25*a*, forms a first supply surface upon receiving varnish supplied from the chamber coater 27 through the anilox roller 26.

In this arrangement, varnish is partially transferred from the resin relief printing plate (first supply surface) 25*a* on the varnish film forming cylinder 25 to the surface of the blanket impression cylinder 22. Hence, when a printed paper sheet passes through the contact point between the blanket impression cylinder 22 and the blanket cylinder 28, the reverse surface of the paper sheet is pattern-coated with varnish transferred from the blanket impression cylinder 22 by the printing pressure of the blanket cylinder 28. At this time, a uniform printing pressure is applied from the blanket impression cylinder 22 to the entire paper sheet because the blanket 66 is attached to the entire peripheral surface of the blanket impression cylinder 22 in contact with the blanket cylinder 28. Accordingly, a uniform and sufficient printing pressure is applied to the coating region on the entire obverse surface of the paper sheet. For this reason, even when pattern coating is necessary for the reverse surface of the paper sheet, the entire obverse surface of the paper sheet can be coated.

A case wherein pattern coating is performed on the obverse surface of a paper sheet, and full coating is performed on the reverse surface of the paper sheet will be described next.

In this case, as shown in FIG. 6C, the blanket 49 is attached to the peripheral surface of the varnish film forming cylinder 25 of the first varnish coating unit 23. A lithographic printing plate bonded to a resin relief printing plate having a pattern coating image formed on its surface is attached to the peripheral surface of the varnish film forming cylinder 29 of the second varnish coating unit 24, as shown in FIG. 6C. A portion on the peripheral surface of the varnish film forming cylinder 29, which corresponds to a resin relief printing plate 29*a*, forms a second supply surface upon receiving varnish supplied from the chamber coater 31 through the anilox roller 30.

In this arrangement, varnish is partially transferred from the resin relief printing plate (second supply surface) 29*a* on the varnish film forming cylinder 29 to the surface of the blanket cylinder 28. When a printed paper sheet passes through the contact point between the blanket impression cylinder 22 and the blanket cylinder 28, the obverse surface of the paper sheet is pattern-coated with varnish transferred from the blanket cylinder 28. At this time, a uniform printing pressure is applied from the blanket cylinder 28 to the entire paper sheet because the blanket 66 is attached to the entire peripheral surface of the blanket cylinder 28 in contact with the blanket impression cylinder 22. Accordingly, a uniform and sufficient printing pressure is applied to the coating region on the entire reverse surface of the paper sheet. For this reason, even when pattern coating is necessary for the obverse surface of the paper sheet, the entire reverse surface of the paper sheet can be coated.

A case wherein pattern coating is performed on both the obverse and reverse surfaces of a paper sheet will be described next.

In this case, lithographic printing plates each bonded to a resin relief printing plate having a pattern coating image formed on its surface are attached to the peripheral surfaces of the varnish film forming cylinder 25 of the first varnish coating unit 23 and the varnish film forming cylinder 29 of the second varnish coating unit 24, as shown in FIG. 6D. In this arrangement, varnish is partially transferred from the resin relief printing plate (second supply surface) 29*a* on the varnish film forming cylinder 29 to the surface of the blanket cylinder 28. When a printed paper sheet passes through the contact point between the blanket impression cylinder 22 and the blanket cylinder 28, the obverse surface of the paper sheet is pattern-coated with varnish transferred from the blanket cylinder 28. Simultaneously, varnish is partially transferred from the resin relief printing plate (first supply surface) 25*a* on the varnish film forming cylinder 25 to the surface of the blanket impression cylinder 22. Hence, the reverse surface of the printed paper sheet that passes through the contact point between the blanket impression cylinder 22 and the blanket cylinder 28 is pattern-coated with varnish transferred from the blanket impression cylinder 22 by the printing pressure of the blanket cylinder 28.

At this time as well, a uniform printing pressure is applied from the blanket cylinder 28 to the entire paper sheet because the blanket 66 is attached to the entire peripheral surface of the blanket cylinder 28 in contact with the blanket impression cylinder 22. Accordingly, a uniform and sufficient printing pressure is applied to the coating region on the reverse surface of the paper sheet. For this reason, even when pattern coating is necessary for the obverse surface of the paper sheet, the reverse surface of the paper sheet can be pattern-coated. Referring to FIGS. 6A and 6B, the peripheral surfaces of the blankets 49 attached to the varnish film forming cylinders 25 and 29 form varnish supply surfaces (first and second supply surfaces).

In this embodiment, the first to fourth plate members are attached to the varnish film forming cylinders 25 and 29, the blanket impression cylinder 22, and the blanket cylinder 28, respectively. As the first or second plate member, a pattern coating plate member partially having a varnish supply surface or a full coating plate member having a varnish supply surface on the entire surface is selectively used. As the third or fourth plate member, a pattern coating plate member partially having a transfer surface and opposing surface or a full coating plate member having a transfer surface and opposing surface on the entire surface is selectively used.

According to this embodiment, coating of any type (any combination of full and pattern coating for the obverse and reverse surfaces) can be performed by only exchanging plate members attached to the varnish film forming cylinders 25 and 29, resulting in an increase in convenience. In addition, no cylinders dedicated to obverse surface coating and reverse surface coating need be prepared. One blanket impression cylinder 22 suffices. For this reason, the apparatus can be made compact, and the manufacturing cost can be reduced.

The second embodiment of the present invention will be described next with reference to FIGS. 7A to 7D.

The second embodiment is only applied to a case wherein pattern coating is performed on both surfaces of a paper sheet. In the second embodiment, blankets are not applied to both a blanket impression cylinder 22 and a blanket cylinder 28, unlike the first embodiment. More specifically, a blanket having a lithographic printing plate shape is attached to only one cylinder. A lithographic printing plate bonded to a resin relief printing plate having a pattern coating image formed on its surface is attached to the other cylinder. Alternatively, lithographic printing plates each bonded to a resin relief printing plate are attached to both the cylinders. Lithographic printing plates each bonded to a resin relief printing plate are attached to varnish film forming cylinders 25 and 29. Portions with the resin relief printing plates form first and second supply surfaces 25*a* and 29*a* upon receiving varnish supplied from chamber coaters 27 and 31 through anilox rollers 26 and 30.

Figure 7D:
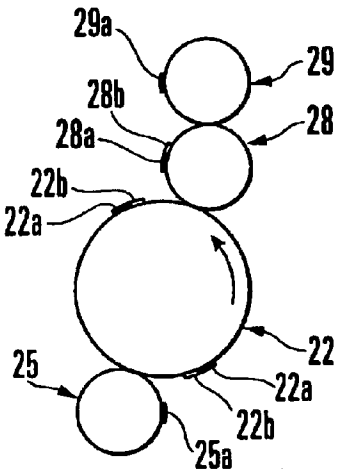
FIGS. 7A to 7D are views for explaining coating methods in a coating apparatus according to the second embodiment of the present invention.
Figure 7C:
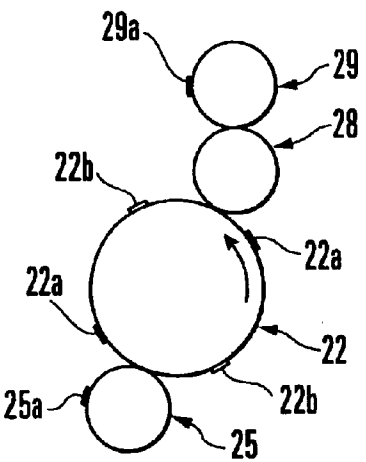
Figure 7B:
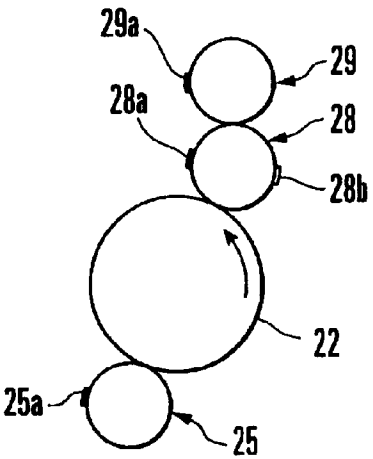
Figure 7A:
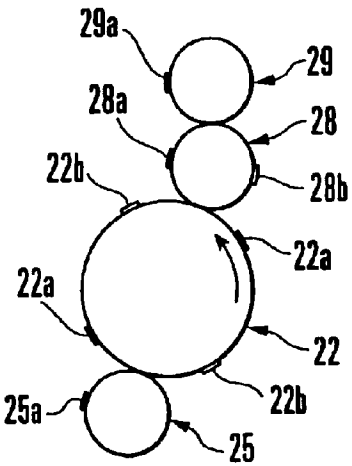
Figure 8:
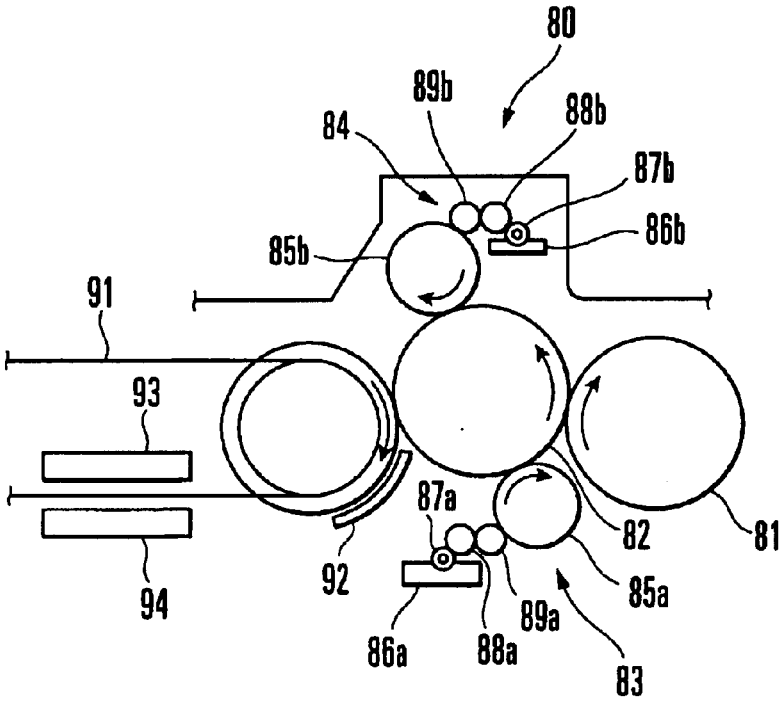
FIG. 8 PRIOR ART
FIG. 8 is a side view of a conventional printing section.
Figure 9:
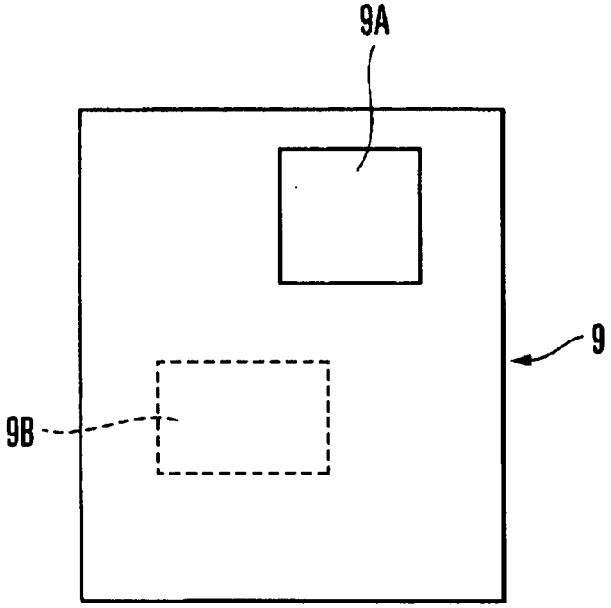
FIG. 9 is a view for explaining pattern coating on the obverse and reverse surfaces of a paper sheet.

Referring to FIG. 7A, lithographic printing plates each bonded to a resin relief printing plate having a pattern coating image formed on its surface are attached to both the blanket impression cylinder 22 and the blanket cylinder 28. More specifically, resin relief printing plates 22*a* and 22*b* are attached to the peripheral surface of the blanket impression cylinder 22. Resin relief printing plates 28*a* and 28*b* are attached to the peripheral surface of the blanket cylinder 28. The resin relief printing plate 22*a* on the blanket impression cylinder 22 comes into contact with the resin relief printing plate (first supply surface) 25*a* on the varnish film forming cylinder 25 to form a first transfer surface to which varnish is transferred from the resin relief printing plate (first supply surface) 25*a*. The resin relief printing plate 28*a* on the blanket cylinder 28 comes into contact with the resin relief printing plate (second supply surface) 29*a* on the varnish film forming cylinder 29 to form a second transfer surface to which varnish is transferred from the resin relief printing plate (second supply surface) 29*a*. The resin relief printing plate 22*b* on the blanket impression cylinder 22 forms a first opposing surface opposing the resin relief printing plate (second transfer surface) 28*a* on the blanket cylinder 28. The resin relief printing plate 28*b* on the blanket cylinder 28 forms a second opposing surface opposing the resin relief printing plate (first transfer surface) 22*a* on the blanket impression cylinder 22.

In this arrangement, when a printed paper sheet passes through the contact point between the blanket impression cylinder 22 and the blanket cylinder 28, the resin relief printing plate (second transfer surface) 28*a* on the blanket cylinder 28 opposes the resin relief printing plate (first opposing surface) 22*b* on the blanket impression cylinder 22. At this time, the obverse surface of the paper sheet is pattern-coated with varnish transferred from the resin relief printing plate (second transfer surface) 28*a*. When the blanket impression cylinder 22 further pivots, the resin relief printing plate (first transfer surface) 22*a* on the blanket impression cylinder 22 opposes the resin relief printing plate (second opposing surface) 28*b* on the blanket cylinder 28. At this time, the reverse surface of the paper sheet is pattern-coated with varnish transferred from the resin relief printing plate (first transfer surface) 22*a*.

The second method of performing pattern coating on both surfaces of a paper sheet will be described next with reference to FIG. 7B.

In the second method, a blanket is attached to the peripheral surface of the blanket impression cylinder 22. In this case, the entire peripheral surface of the blanket impression cylinder 22 forms the first transfer surface and first opposing surface. In this arrangement, when the resin relief printing plate (first supply surface) 25*a* on the varnish film forming cylinder 25 comes into contact with the blanket impression cylinder 22, varnish is transferred from the resin relief printing plate (first supply surface) 25*a* to part of the blanket on the blanket impression cylinder 22. The varnish transferred to the blanket impression cylinder 22 opposes the resin relief printing plate (second opposing surface) 28*b* on the blanket cylinder 28. Hence, the reverse surface of the paper sheet that passes through the contact point between the blanket impression cylinder 22 and the blanket cylinder 28 is pattern-coated. When the blanket impression cylinder 22 further pivots, the resin relief printing plate (second transfer surface) 28*a* on the blanket cylinder 28 opposes the blanket impression cylinder 22. Then, the obverse surface of the paper sheet is pattern-coated with varnish transferred from the resin relief printing plate (second transfer surface) 28*a* by the printing pressure of the blanket impression cylinder 22.

The third method of performing pattern coating on both surfaces of a paper sheet will be described next with reference to FIG. 7C.

In the third method, a blanket is attached to the peripheral surface of the blanket cylinder 28. In this case, the entire peripheral surface of the blanket cylinder 28 forms the second transfer surface and second opposing surface. In this arrangement, when the resin relief printing plate (second supply surface) 29*a* on the varnish film forming cylinder 29 comes into contact with the blanket cylinder 28, varnish is transferred from the resin relief printing plate (second supply surface) 29*a* to part of the blanket on the blanket cylinder 28. The varnish transferred to the blanket cylinder 28 opposes the resin relief printing plate (first opposing surface) 22*b* on the blanket impression cylinder 22. Hence, the obverse surface of the paper sheet that passes through the contact point between the blanket impression cylinder 22 and the blanket cylinder 28 is pattern-coated. When the blanket impression cylinder 22 further pivots, the resin relief printing plate (first transfer surface) 22*a* on the blanket impression cylinder 22 opposes the blanket cylinder 28. Then, the reverse surface of the paper sheet is pattern-coated with varnish transferred from the resin relief printing plate (first transfer surface) 22*a* by the printing pressure of the blanket cylinder 28.

The fourth method of performing pattern coating on both surfaces of a paper sheet will be described next with reference to FIG. 7D.

In the fourth method, a case wherein pattern coating on the obverse surface of a paper sheet partially overlaps that on the reverse surface, i.e., images on the obverse and reverse surfaces partially overlap each other will be described. In this case, the resin relief printing plate (first transfer surface) 22*a* on the blanket impression cylinder 22 partially overlaps the resin relief printing plate (first opposing surface) 22*b*. In addition, the resin relief printing plate (second transfer surface) 28*a* on the blanket cylinder 28 partially overlaps the resin relief printing plate (second opposing surface) 28*b*. Hence, the obverse and reverse surfaces of a paper sheet that passes through the contact point between the blanket impression cylinder 22 and the blanket cylinder 28 are almost simultaneously pattern-coated.

In this embodiment, the obverse surface printing units 6A to 6D and reverse surface printing units 7A to 7D are arranged in two lines on the upper and lower sides. However, the printing units may be arranged in one line by preparing inverting cylinders. The present invention can also be applied to a dedicated coater which has no printing section 3 and performs only coating. A rubber blanket having a three-dimensional pattern may be wound around the surface of the varnish film forming cylinder 25 or 29. For full coating, a lithographic printing plate (PS plate) may be wound. When water-based varnish is used, pattern coating can be executed by winding a lithographic printing plate (PS plate) around the varnish film forming cylinder 25 or 29. In this way, various deign changes are possible.

The holding structure of the blanket 66 on the blanket cylinder 22 or 28 may be a so-called bottom clamping rail structure disclosed in, e.g., Japanese Utility Model No. 2579258 (reference 3). The varnish supply unit may supply varnish stored in a varnish pan by rollers in contact with each other, as disclosed in Japanese Patent Laid-Open No. 10-296953 (reference 4).

The present invention is applied to a machine in which a sheet is fed by a feeder unit. However, the present invention can also be applied to a machine in which a sheet obtained by cutting web paper is fed. Additionally, in this embodiment, the paper sheet 9 is used as a sheet-like matter. The same effect as described above can also be obtained by using a film or a polyvinyl chloride sheet.

As has been described above, according to the present invention, even when coating is to performed on both surfaces of a sheet-like matter, and coating positions on the obverse and reverse surfaces do not completely match, both surfaces of the sheet-like matter can reliably be coated. In addition, the apparatus can be made compact, and the manufacturing cost can be reduced. Furthermore, coating of any type can be performed by only exchanging plate members attached to varnish film forming cylinders, resulting in an increase in convenience.

What is claimed is:

1. A varnish coating apparatus comprising:

a first varnish film forming cylinder having a first supply surface to which varnish is supplied;

a second varnish film forming cylinder having a second supply surface to which varnish is supplied;

a first blanket cylinder having a first transfer surface in contact with the first supply surface of said first varnish film forming cylinder and a first opposing surface corresponding to the second supply surface of said second varnish film forming cylinder; and a second blanket cylinder arranged in contact with said first blanket cylinder and having a second transfer surface in contact with the second supply surface of said second varnish film forming cylinder and a second opposing surface corresponding to the first supply surface of said first varnish film forming cylinder, wherein when a sheet passes through a contact point between said first and second blanket cylinders, the first transfer surface of said first blanket cylinder opposes the second opposing surface of said second blanket cylinder to perform varnish coating on a first surface of the sheet, and the second transfer surface of said second blanket cylinder opposes the first opposing surface of said first blanket cylinder so as to perform varnish coating on a second surface of the sheet, wherein a first plate member having the first supply surface is attached to a peripheral surface of said first varnish film forming cylinder, and a second plate member having the second supply surface is attached to a peripheral surface of said second varnish film forming cylinder.

2. An apparatus according to claim 1, wherein a pattern coating plate member partially having the first supply surface is attached to the peripheral surface of said first varnish film forming cylinder as the first plate member, and a pattern coating plate member partially having the second supply surface is attached to the peripheral surface of said second varnish film forming cylinder as the second plate member.

3. An apparatus according to claim 2, wherein each of the pattern coating plate members is formed from a lithographic printing plate bonded to a resin relief printing plate having a pattern coating image formed on a surface, and the surfaces of the resin relief printing plates attached to the first and second varnish film forming cylinders form the first and second supply surfaces.

4. An apparatus according to claim 2, wherein a third plate member for full coating, which has the first transfer surface and first opposing surface on an entire surface, is attached to the peripheral surface of said first blanket cylinder, and a fourth plate member for full coating, which has the second transfer surface and second opposing surface on an entire surface, is attached to the peripheral surface of said second blanket cylinder.

5. An apparatus according to claim 1, wherein a full coating plate member having the first supply surface on an entire surface is attached to the peripheral surface of said first varnish film forming cylinder as the first plate member, and a pattern coating plate member partially having the second supply surface is attached to the peripheral surface of said second varnish film forming cylinder as the second plate member.

6. An apparatus according to claim 5, wherein a third plate member for full coating, which has the first transfer surface and first opposing surface on an entire surface, is attached to the peripheral surface of said first blanket cylinder, and a fourth plate member for full coating, which has the second transfer surface and second opposing surface on an entire surface, is attached to the peripheral surface of said second blanket cylinder.

7. An apparatus according to claim 1, wherein a pattern coating plate member partially having the first supply surface is attached to the peripheral surface of said first varnish film forming cylinder as the first plate member, and a full coating plate member having the second supply surface on an entire surface is attached to the peripheral surface of said second varnish film forming cylinder as the second plate member.

8. An apparatus according to claim 1, wherein a full coating plate member having the first supply surface on an entire surface is attached to the peripheral surface of said first varnish film forming cylinder as the first plate member, and a full coating plate member having the second supply surface on an entire surface is attached to the peripheral surface of said second varnish film forming cylinder as the second plate member.

9. An apparatus according to claim 1, wherein a third plate member having the first transfer surface and first opposing surface is attached to a peripheral surface of said first blanket cylinder, and a fourth plate member having the second transfer surface and second opposing surface is attached to a peripheral surface of said second blanket cylinder.

10. An apparatus according to claim 9, wherein a full coating plate member having the first transfer surface and first opposing surface on an entire surface is attached to the peripheral surface of said first blanket cylinder as the third plate member, and a full coating plate member having the second transfer surface and second opposing surface on an entire surface is attached to the peripheral surface of said second blanket cylinder as the fourth plate member.

11. An apparatus according to claim 9, wherein a pattern coating plate member partially having the first transfer surface and first opposing surface is attached to the peripheral surface of said first blanket cylinder as the third plate member, and a pattern coating plate member partially having the second transfer surface and second opposing surface is attached to the peripheral surface of said second blanket cylinder as the fourth plate member.

12. An apparatus according to claim 11, wherein the first transfer surface and the first opposing surface are arranged while partially overlapping each other, and the second transfer surface and the second opposing surface are arranged while partially overlapping each other.

13. An apparatus according to claim 11, wherein each of the pattern coating plate members is formed from a lithographic printing plate bonded to a resin relief printing plate having a pattern coating image formed on a surface, the surface of the resin relief printing plate attached to the first varnish film forming cylinder forms the first transfer surface and first opposing surface, and the surface of the resin relief printing plate attached to the second varnish film forming cylinder forms the second transfer surface and second opposing surface.

14. An apparatus according to claim 9, wherein a full coating plate member having the first transfer surface and first opposing surface on an entire surface is attached to the peripheral surface of said first blanket cylinder as the third plate member, and a pattern coating plate member partially having the second transfer surface and second opposing surface is attached to the peripheral surface of said second blanket cylinder as the fourth plate member.

15. An apparatus according to claim 9, wherein a pattern coating plate member partially having the first transfer surface and first opposing surface is attached to the peripheral surface of said first blanket cylinder as the third plate member, and a full coating plate member having the second transfer surface and second opposing surface on an entire surface is attached to the peripheral surface of said second blanket cylinder as the fourth plate member.

16. A varnish coating apparatus comprising:

a first varnish film forming cylinder having a first supply surface to which varnish is supplied;

a second varnish film forming cylinder having a second supply surface to which varnish is supplied;

a first blanket cylinder having a first transfer surface in contact with the first supply surface of said first varnish film forming cylinder and a first opposing surface corresponding to the second supply surface of said second varnish film forming cylinder; and a second blanket cylinder arranged in contact with said first blanket cylinder and having a second transfer surface in contact with the second supply surface of said second varnish film forming cylinder and a second opposing surface corresponding to the first supply surface of said first varnish film forming cylinder.

wherein when a sheet passes through a contact point between said first and second blanket cylinders, the first transfer surface of said first blanket cylinder opposes the second opposing surface of said second blanket cylinder to perform varnish coating on a first surface of the sheet, and the second transfer surface of said second blanket cylinder opposes the first opposing surface of said first blanket cylinder so as to perform varnish coating on a second surface of the sheet, wherein one of a pattern coating plate member partially having the first supply surface and a full coating plate member having the first supply surface on an entire surface is selectively attached to a peripheral surface of said first varnish film forming cylinder as the first plate member, and one of a pattern coating plate member partially having the second supply surface and a full coating plate member having the second supply surface on an entire surface is selectively attached to a peripheral surface of said second varnish film forming cylinder as the second plate member.

* * * * *